US009177713B2

(12) United States Patent
Kawashima

(10) Patent No.: US 9,177,713 B2
(45) Date of Patent: Nov. 3, 2015

(54) WINDING STRUCTURE, COIL WINDING, COIL PART, AND COIL WINDING MANUFACTURING METHOD

(71) Applicant: SUMIDA CORPORATION, Chuo-ku, Tokyo (JP)

(72) Inventor: Hiroshi Kawashima, Tokyo (JP)

(73) Assignee: SUMIDA CORPORATION (JP)

( * ) Notice: Subject to any disclaimer, the term of this patent is extended or adjusted under 35 U.S.C. 154(b) by 0 days.

(21) Appl. No.: 14/090,903

(22) Filed: Nov. 26, 2013

(65) Prior Publication Data

US 2014/0152414 A1 Jun. 5, 2014

(30) Foreign Application Priority Data

Dec. 5, 2012 (JP) ..... 2012-266622

(51) Int. Cl.

*H01F 27/28* (2006.01)
*H01F 27/29* (2006.01)
*H01F 41/06* (2006.01)

(52) U.S. Cl.

CPC ..... *H01F 27/29* (2013.01); *H01F 27/28* (2013.01); *H01F 27/2847* (2013.01); *H01F 41/0604* (2013.01); *H01F 41/065* (2013.01)

(58) Field of Classification Search

CPC ..... H01F 5/00; H01F 27/00–27/30
USPC ..... 336/180–184, 220–223
See application file for complete search history.

(56) References Cited

U.S. PATENT DOCUMENTS

| | | | | |
|---|---|---|---|---|
| 8,056,212 | B2 * | 11/2011 | Hattori et al. | 29/602.1 |
| 2003/0016112 | A1 | 1/2003 | Brocchi | |
| 2009/0144967 | A1 * | 6/2009 | Hasu et al. | 29/605 |
| 2011/0279208 | A1 | 11/2011 | Ono | |
| 2011/0279210 | A1 | 11/2011 | Ono | |
| 2012/0124821 | A1 | 5/2012 | Lungu | |
| 2012/0154100 | A1 * | 6/2012 | Hasu et al. | 336/223 |
| 2013/0333432 | A1 | 12/2013 | Honda | |

FOREIGN PATENT DOCUMENTS

| | | | |
|---|---|---|---|
| EP | 0371933 | A1 | 6/1990 |
| EP | 1271574 | A1 | 1/2003 |
| EP | 2251959 | A1 | 11/2010 |
| EP | 2387048 | A2 | 11/2011 |
| EP | 2387049 | A1 | 11/2011 |
| FR | 2609205 | A1 | 7/1988 |
| JP | 60091603 | A | 5/1985 |
| JP | 07220928 | A | 8/1995 |
| JP | 10-172852 | B2 | 6/1998 |
| JP | 2004055920 | A | 2/2004 |

(Continued)

OTHER PUBLICATIONS

Extended European Search Report for the International Application No. 13005502.3-155612741304, mailed on May 26, 2014.

(Continued)

*Primary Examiner* — Tuyen Nguyen
(74) *Attorney, Agent, or Firm* — Cantor Colburn LLP

(57) ABSTRACT

There is provided a winding structure, a coil winding, a coil part, and a coil winding manufacturing method, which are capable of preventing occurrence of an extra space due to existence of a connecting wire part when two winding parts and a connecting wire part connecting the winding parts are formed.

8 Claims, 19 Drawing Sheets

(56) References Cited

FOREIGN PATENT DOCUMENTS

| | | | |
|---|---|---|---|
| JP | 2005057113 | A | 3/2005 |
| JP | 2008187868 | A | 8/2008 |
| JP | 2008277606 | A | 11/2008 |
| JP | 2009129961 | A | 6/2009 |
| JP | 2010206029 | A | 9/2010 |
| JP | 2011243661 | A1 | 12/2011 |
| JP | 2011243663 | A | 12/2011 |
| JP | 2013258306 | A | 12/2013 |
| JP | 2014039008 | A | 2/2014 |

OTHER PUBLICATIONS

Japanese Notice of Reasons for Rejection corresponding to Application No. 2012-266622; Date of Mailing: Dec. 16, 2014, with English translation.

* cited by examiner

WINDING STRUCTURE, COIL WINDING, COIL PART, AND COIL WINDING MANUFACTURING METHOD

The present invention claims priority under 35 U.S.C. §119 to Japanese Application No. 2012-266622 filed Dec. 5, 2012, the entire content of which is incorporated herein by reference.

BACKGROUND OF THE INVENTION

1. Field of the Invention

The present invention relates to a winding structure, a coil winding, a coil part, and a coil winding manufacturing method.

2. Description of the Related Art

In a drive unit for driving wheels of an automobile with a power generator which utilizes natural energy, a power supply device, and a motor, a coil part (reactor) is used in an electric circuit in order to improve power efficiency and remove noise. In such a coil part, for the purpose of corresponding to large electric current and improving a space factor, a flat wire is generally used. Patent Document 1 describes a coil part using such a flat wire.

[Patent Document 1] Japanese Patent No. 3398855 (see FIG. 4 to FIG. 6)

SUMMARY OF THE INVENTION

In the structure of Patent Document 1, a twisted portion exists in a part (connecting wire part) between a first winding part (first coil part) and a second winding part (second coil part), and the winding parts are provided so that an electric current flowing through the flat wire is inverted between the first winding part and the second winding part by this twisted portion.

Here, FIG. 18 illustrates a plan view of a coil winding 20P in which a twisted portion similar to that of Patent Document 1 exists. Further, FIG. 19 illustrates a partial side view of a coil part 10P in which the twisted portion exists. When the twisted portion 25P as illustrated in FIG. 18 exists, an extra space approximately equal to the width of a flat wire H is needed in an inside (ring hole 30P) of a ring-shaped core 31P, as illustrated in FIG. 19. Dimensions of the coil part 10P become large by that such an extra space is needed, which hinders miniaturization of the coil part 10P.

The present invention is made in view of such problems, and it is an object thereof to provide a winding structure, a coil winding, a coil part, and a coil winding manufacturing method, which are capable of preventing occurrence of an extra space due to existence of a connecting wire part when a flat wire is processed to form two winding parts and a connecting wire part connecting the winding parts.

To solve the above-described problem, one aspect of a winding structure of the present invention has: a first winding part formed by winding a flat wire; a second winding part formed by winding the flat wire continuing to the first winding part, the second winding part being wound in a same winding direction as a winding direction of the first winding part; and a part to be connecting wire located between the first winding part and the second winding part to connect the winding parts, wherein the part to be connecting wire has: an interval defining portion defining an interval between the first winding part and the second winding part; a first coupling portion with one end side continuing to the interval defining portion by forming an edgewise bending and another end side continuing to the first winding part on one side in an axial direction of the first winding part; and a second coupling portion with one end side continuing to the interval defining portion by forming an edgewise bending and another end side continuing to the second winding part on another side in an axial direction of the second winding part.

Further, in another aspect of the winding structure of the present invention, in addition to the above-described invention, preferably, the first coupling portion is provided with: a planar extending portion continuing to the interval defining portion by forming an edgewise bending; and a portion for twisting which is located between the first winding part and the planar extending portion and becomes a twisted portion by twisting.

Moreover, in another aspect of the winding structure of the present invention, in addition to the above-described invention, preferably, a first terminal on a side opposite to the part to be connecting wire in the first winding part and a second terminal on a side opposite to the part to be connecting wire in the second winding part extend in opposite directions from each other toward respective front end sides thereof, and one of the first terminal and the second terminal is located on a facing portion side where the first winding part and the second winding part face each other, and the other of the first terminal and the second terminal is located on an outer peripheral side where the first winding part and the second winding part do not face each other.

Further, preferably, a coil winding which is another invention of the present invention uses the above-described winding structure, wherein a boundary portion between the first coupling portion and the first winding part is bent so that the first coupling portion extends in a direction to depart from the first winding part, a boundary portion between the second coupling portion and the second winding part is bent so that the second coupling portion extends in a direction to depart from the second winding part, and a connecting wire part is formed from the part to be connecting wire by the bending of the boundary portions.

Moreover, in another aspect of the coil winding of the present invention, in addition to the above-described invention, preferably, the boundary portion between the first coupling portion and the first winding part is bent so that an extending direction of the first coupling portion is provided in substantially parallel with an axial direction of the first winding part, and the boundary portion between the second coupling portion and the second winding part is bent so that an extending direction of the second coupling portion is provided in substantially parallel with an axial direction of the second winding part.

Further, in another aspect of the coil winding of the present invention, in addition to the above-described invention, preferably, the boundary portion between the first coupling portion and the first winding part is bent so that an extending direction of the first coupling portion is provided obliquely with respect to an axial direction of the first winding part, and the boundary portion between the second coupling portion and the second winding part is bent so that an extending direction of the second coupling portion is provided obliquely with respect to an axial direction of the second winding part.

Moreover, preferably, a coil winding which is another invention of the present invention uses the above-described winding structure, wherein the flat wire located in the portion for twisting is twisted to form a twisted portion in which a width direction of the flat wire extends in a direction to depart from the first winding part, and a boundary portion between the second coupling portion and the second winding part is bent so that the second coupling portion extends in a direction to depart from the second winding part.

Further, in another aspect of the coil winding of the present invention, in addition to the above-described invention, preferably, a first terminal on a side opposite to the connecting wire part in the first winding part and a second terminal on a side opposite to the connecting wire part in the second winding part extend in a same direction as each other toward respective front end sides thereof, and one of the first terminal and the second terminal is located on a facing portion side where the first winding part and the second winding part face each other, and the other of the first terminal and the second terminal is located on an outer peripheral side where the first winding part and the second winding part do not face each other.

Moreover, preferably, a coil part which is another invention of the present invention has the above-described coil winding and a core body formed from a magnetic material, provided in a ring shape, and inserted through a center hole of the first winding part and a center hole of the second winding part.

Further, preferably, a coil winding manufacturing method which is another invention of the present invention is a coil winding manufacturing method for forming a coil winding from a flat wire, the method including: a first winding step of winding the flat wire to form a first winding part; a part to be connecting wire forming step of forming a part to be connecting wire continuing to the first winding part; a second winding step of winding the flat wire in a same winding direction as a winding direction of the first winding part to form a second winding part continuing to the part to be connecting wire; and a connecting wire part forming step of forming a connecting wire part from the part to be connecting wire, wherein the part to be connecting wire forming step has: a first feeding step of feeding, after the first winding step and before the second winding step, the flat wire farther than a bending part to provide a first fed portion continuing to the first winding part; a first bending step of performing, at the bending part after the first feeding step, edgewise bending of the flat wire in the same direction as the winding direction of the first winding part to form a first coupling portion continuing to the first winding part; a second feeding step of feeding, after the first bending step, the flat wire to provide a second fed portion; a second bending step of performing, at the bending part after the second feeding step, edgewise bending of the flat wire in the same direction as the winding direction of the first winding part to form an interval defining portion continuing to the first coupling portion and defining an interval between the first winding part and the second winding part; and a third feeding step of feeding, after the second bending step, the flat wire farther than the bending part to provide a third fed portion continuing to the interval defining portion and the second winding part.

According to the present invention, it becomes possible to provide a winding structure, a coil winding, a coil part, and a coil winding manufacturing method, which are capable of preventing occurrence of an extra space due to existence of a connecting wire part when a flat wire is processed to form two winding parts and a connecting wire part connecting the winding parts.

DETAILED DESCRIPTION OF THE PREFERRED EMBODIMENT

Figure 1:
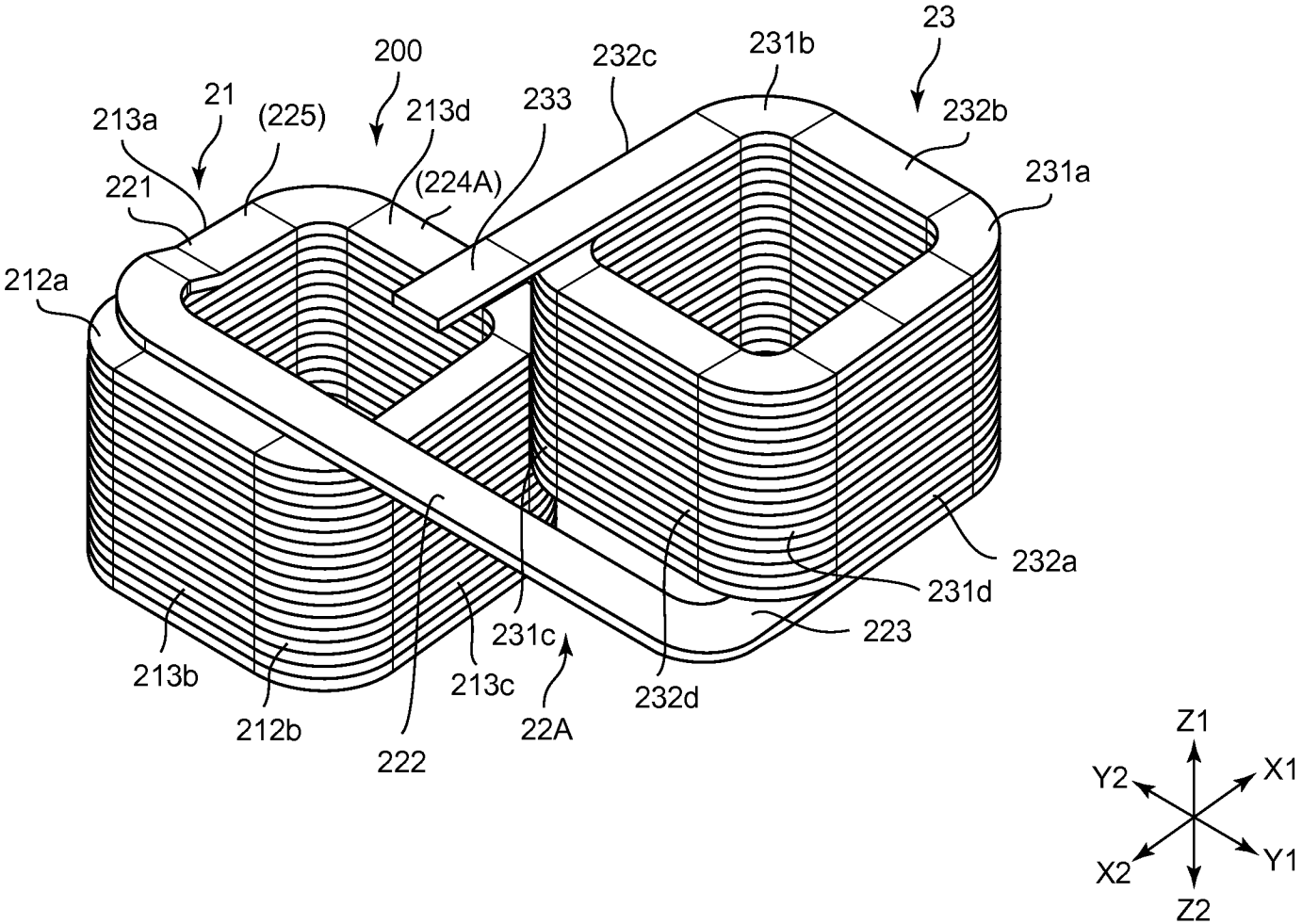
FIG. 1 is a perspective view illustrating a shape of a winding structure according to one embodiment of the present invention.

Hereinafter, a coil part 10 (coil parts 10A to 10C; see FIG. 15 to FIG. 17) according to one embodiment of the present invention will be described based on the drawings. Note that in the following description, manufacturing processes are described together when a coil winding 20 (coil windings 20A to 20C; see FIG. 6, FIG. 8, and FIG. 10) of a coil part 10 is described.

Note that in the following description, an axial direction of the coil winding 20 and a winding structure 200 is denoted as Z direction, a side facing toward a terminal portion 233 (which will be described later) from a terminal portion 211 (which will be described later) in the Z direction is denoted as Z1 side, and an opposite side thereof is denoted as Z2 side. Further, a direction in which the terminal portion 233 and the terminal portion 211 extend is denoted as X direction, a side where the terminal portion 211 projects (see FIG. 2 and the like) with respect to a first winding part 21 (which will be described later) is denoted as X1 side, and the opposite side thereof (see FIG. 1 and the like; a side where the terminal portion 233 projects) is denoted as X2 side. Further, a direction orthogonal to the X direction and the Z direction is denoted as Y direction, a side where a second winding part 23 is located with respect to the first winding part 21 is denoted as Y1 side, and the opposite side thereof is denoted as Y2 side.

Further, in the following description, when it is unnecessary to distinguish the coil parts 10A to 10C from each other, they are referred to as a coil part 10. Also when it is unnecessary to distinguish coil windings 20A to 20C from each other, they are referred to as a coil winding 20.

<Regarding Formation of a Winding Structure 200>

First, formation of a winding structure 200 during manufacturing of the coil winding 20 will be described.

Figure 2:
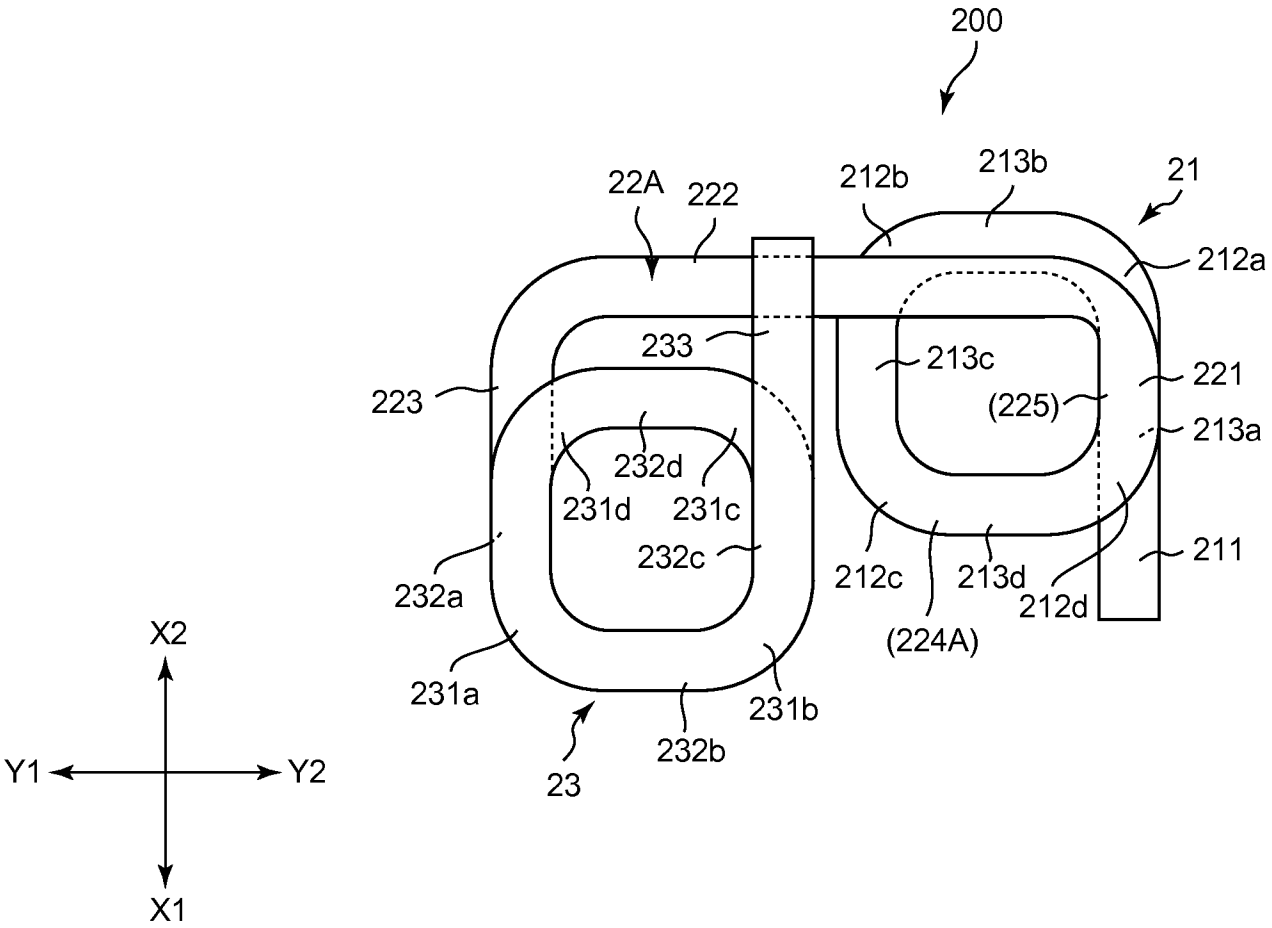
FIG. 2 is a plan view illustrating the shape of the winding structure of FIG. 1.

FIG. 1 is a perspective view illustrating the winding structure 200. FIG. 2 is a plan view illustrating the winding structure 200. This winding structure 200 has a first winding part 21, a part to be connecting wire 22A, and a second winding part 23.

Figure 3A:
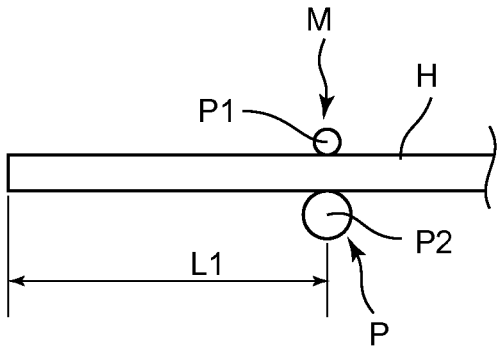
FIGS. 3A and 3B illustrate a manufacturing method of the winding structure, FIG. 3A being a diagram illustrating a state that a flat wire before being bent is fed by a length L1, FIG. 3B being a diagram illustrating a state that the flat wire fed by the length L1 is bent.

When the winding structure 200 as illustrated in FIG. 1 and FIG. 2 is formed, first, a flat wire H is pulled off a supply source where the flat wire H is wound, such as a bobbin or reel, and the flat wire H is set to a bending machine (omitted from the illustrations). Thereafter, as illustrated in FIG. 3A, a feeding unit (omitted from the illustrations) of the bending machine is activated to feed the flat wire H by a predetermined length L1.

At this time, the flat wire H is fed by a length L1 of the sum of the terminal portion 211 and a straight portion 213*a* in the first winding part 21 of FIG. 1, which will be described later, and by this feeding, a portion corresponding to a bent portion 212*a* in FIG. 1 is located at a bending part M of the bending machine illustrated in FIG. 3A. At the bending part M, an inner jig P1 and an outer jig P2 are disposed, which constitute a processing unit P of the bending machine. The inner jig P1 is disposed on an inner peripheral side when bending of the flat wire H is performed, and the outer jig P2 is disposed on an outer peripheral side when bending of the flat wire H is performed.

Figure 3B:
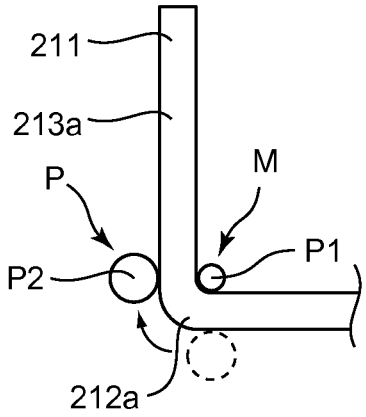

When the processing unit P of the bending machine is then activated, as illustrated in FIG. 3B, bending of the flat wire H is performed so that the flat wire H follows an outer peripheral surface of the inner jig P1. In this bending, a longitudinal (extending) direction and a width direction of the flat wire H are bent by approximately 90 degrees, but a thickness direction of the flat wire H is in a barely changed (bent) state. By this bending, the terminal portion 211 (corresponding to a first terminal) and the straight portion 213*a* in the first winding part 21 illustrated in FIG. 1 and FIG. 2 are formed in an integrated state. Note that in the following description, "approximately 90 degrees" include just 90 degrees or an angle equivalent to 90 degrees.

Thereafter, feeding of the flat wire H by actuation of the feeding unit of the bending machine and bending by actuation of the processing unit P of the bending machine are performed sequentially in a similar manner Thus, the first winding part 21 is formed which is wound in a rectangular shape (what is called an edgewise winding) and has four bent portions 212*a* to 212*d* and four straight portions 213*a* to 213*d*.

Figure 4A:
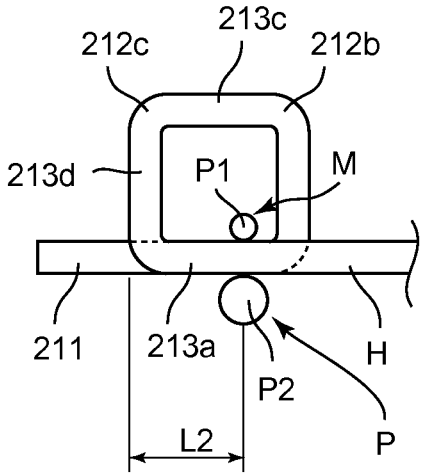
FIGS. 4A and 4B illustrate the manufacturing method of the winding structure, FIG. 4A being a diagram illustrating a state that the flat wire is fed by a length L2 corresponding to a first coupling portion of a part to be connecting wire, FIG. 4B being a diagram illustrating a state that the flat wire is fed by a length L3 corresponding to an interval defining portion of a part to be connecting wire.

After the first winding part 21 is formed, the feeding unit of the bending machine is actuated to feed the flat wire H by a length L2 corresponding to a first coupling portion 221 of the part to be connecting wire 22A as illustrated in FIG. 4A. In the structure illustrated in FIG. 4A, the flat wire H is fed by the length L2 corresponding to the first coupling portion 221 so that it continues to the bent portion 212*d* (corresponding to a first feeding step; note that this fed portion corresponds to a first fed portion) and the end of the fed portion is positioned at the bending part M. Thereafter, the processing unit P of the bending machine is actuated to bend the flat wire H in the same winding direction as the winding direction of the first winding part 21 (corresponding to a first bending step). Thus, the first coupling portion 221 continuing to the first winding part 21 is formed.

Figure 4B:
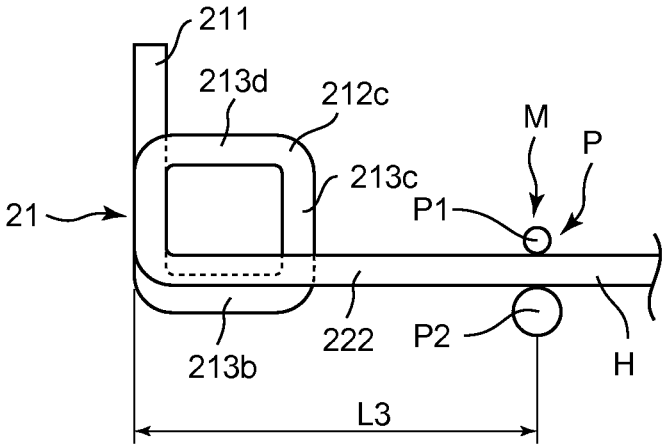

Further, after the first coupling portion 221 is formed, the feeding unit of the bending machine is actuated to feed the flat wire H by a length L3 corresponding to an interval defining portion 222, as illustrated in FIG. 4B (corresponding to a second feeding step; note that this fed portion corresponds to a second fed portion). Then, the end of the fed portion is positioned at the bending part M. Thereafter, the processing unit P of the bending machine is actuated to bend the flat wire H in the same winding direction as the winding direction of the first winding part 21 (corresponding to a second bending step). Thus, the interval defining portion 222 continuing to the first coupling portion 221 is formed.

Figure 5A:
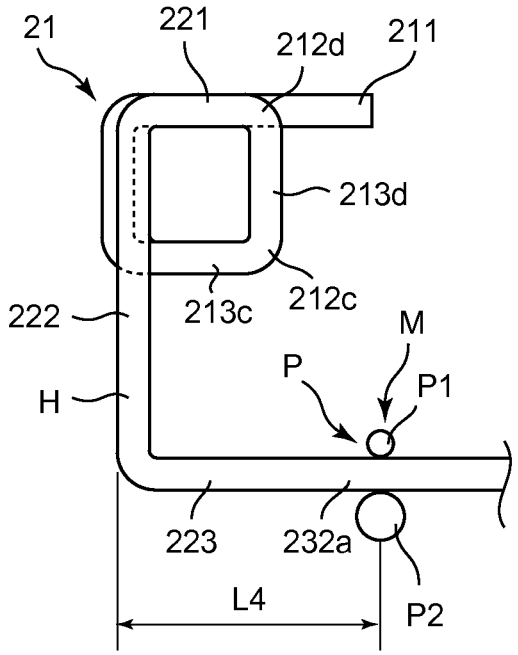
FIGS. 5A and 5B illustrate the manufacturing method of the winding structure, FIG. 5A being a diagram illustrating a state that a length L4 of the sum of a length corresponding to a second coupling portion and a straight portion of the second winding part is fed, FIG. 5B being a diagram illustrating a state that the fed flat wire is bent.
Figure 5B:
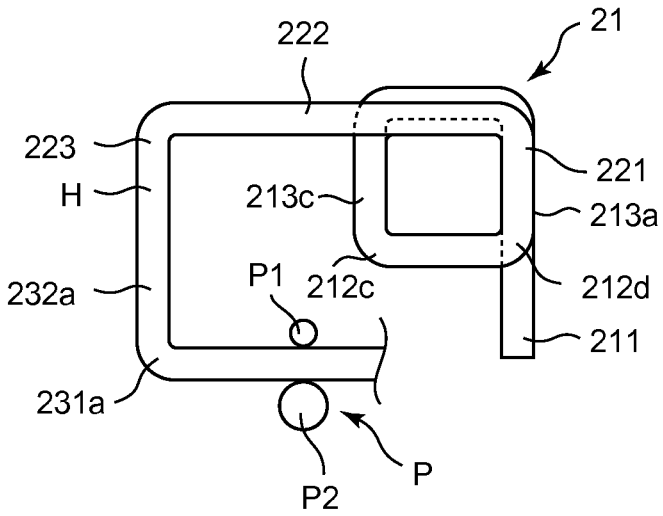

Next, after the interval defining portion 222 is formed, as illustrated in FIG. 5A, the feeding unit of the bending machine is actuated to feed a length L4 of the sum of a length corresponding to a second coupling portion 223 (the length of the second coupling portion 223 is equal to that of the first coupling portion 221) and a straight portion 232*a* of the second winding part 23 (corresponding to a third feeding step; note that this fed portion corresponds to a third fed portion), and a portion corresponding to a bent portion 231*a* of the second winding part 23 is positioned at the bending part M of the bending machine. Then, the processing unit of the bending machine is actuated to bend the flat wire H in the same winding direction as the winding direction of the first winding part 21 (corresponding to a second bending step). Thus, as illustrated in FIG. 5B, the second coupling portion 223 and the straight portion 232*a* are formed in an integrated state.

Note that the first coupling portion 221, the interval defining portion 222, and the second coupling portion 223 constitute the part to be connecting wire 22A connecting the first winding part 21 and the second winding part 23. The part to be connecting wire 22A is a part which becomes a connecting wire part 22 by undergoing bending, or bending and twisting, as will be described later.

Thereafter, feeding of the flat wire H by actuation of the feeding unit of the bending machine and bending by actuation of the processing unit of the bending machine are performed sequentially in a manner similar to the formation of the first winding part 21. Thus, the second winding part 23 is formed which is wound in a rectangular shape (what is called an edgewise winding) and has four bent portions 231*a* to 231*d* and four straight portions 232*a* to 232*d*.

Note that when the last bending of the second winding part 23 is performed, the terminal portion 233 (corresponding to a second terminal) and the straight portion 232*c* in the second winding part 23 are formed in an integrated state. Thus, the winding structure 200 as illustrated in FIG. 1 and FIG. 2 is formed.

<Regarding Formation of the Coil Winding 20>

Figure 8:
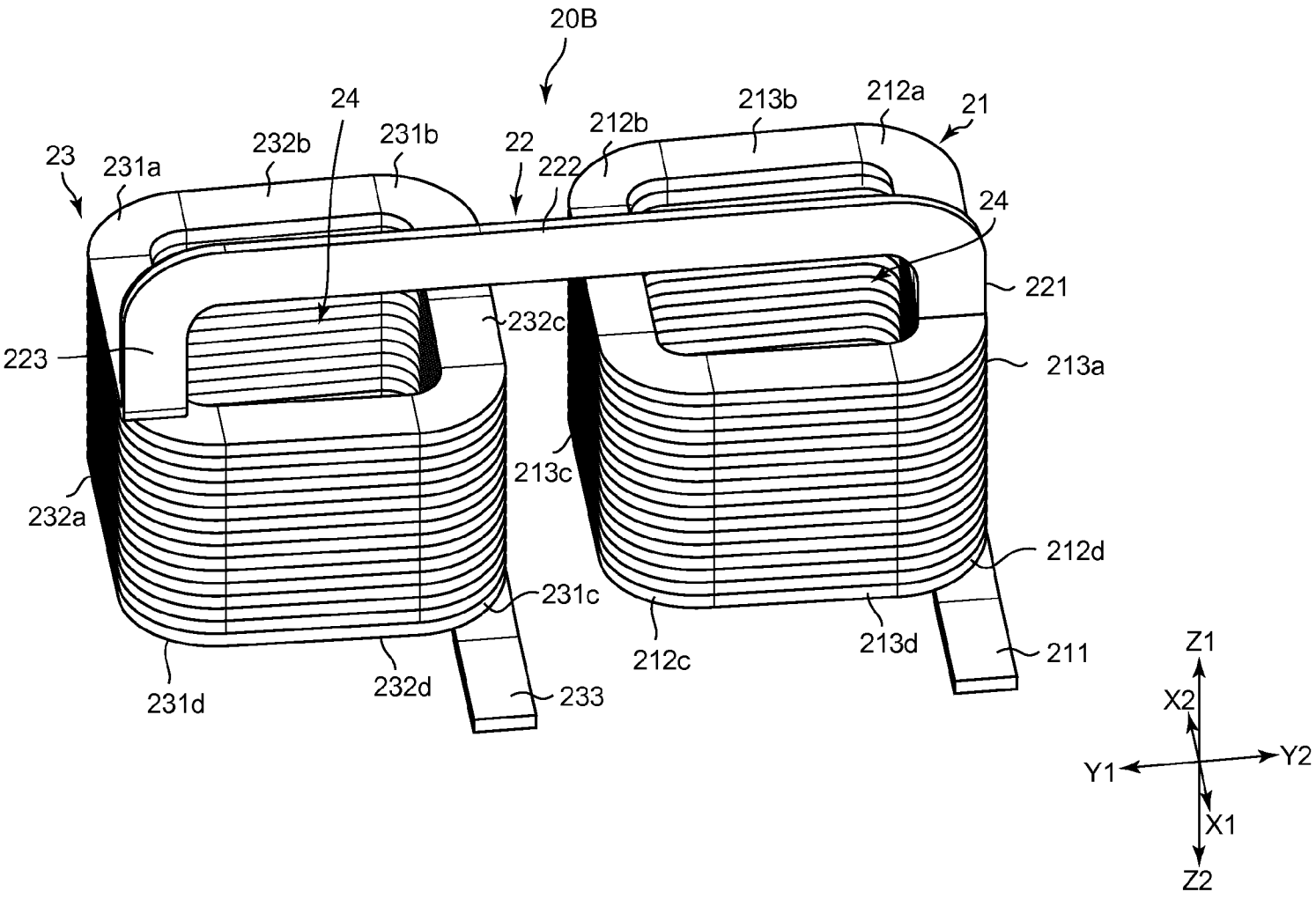
FIG. 8 is a perspective view illustrating a shape of a coil winding formed from the winding structure of FIG. 1 and is a view illustrating a type different from FIG. 6.
Figure 10:
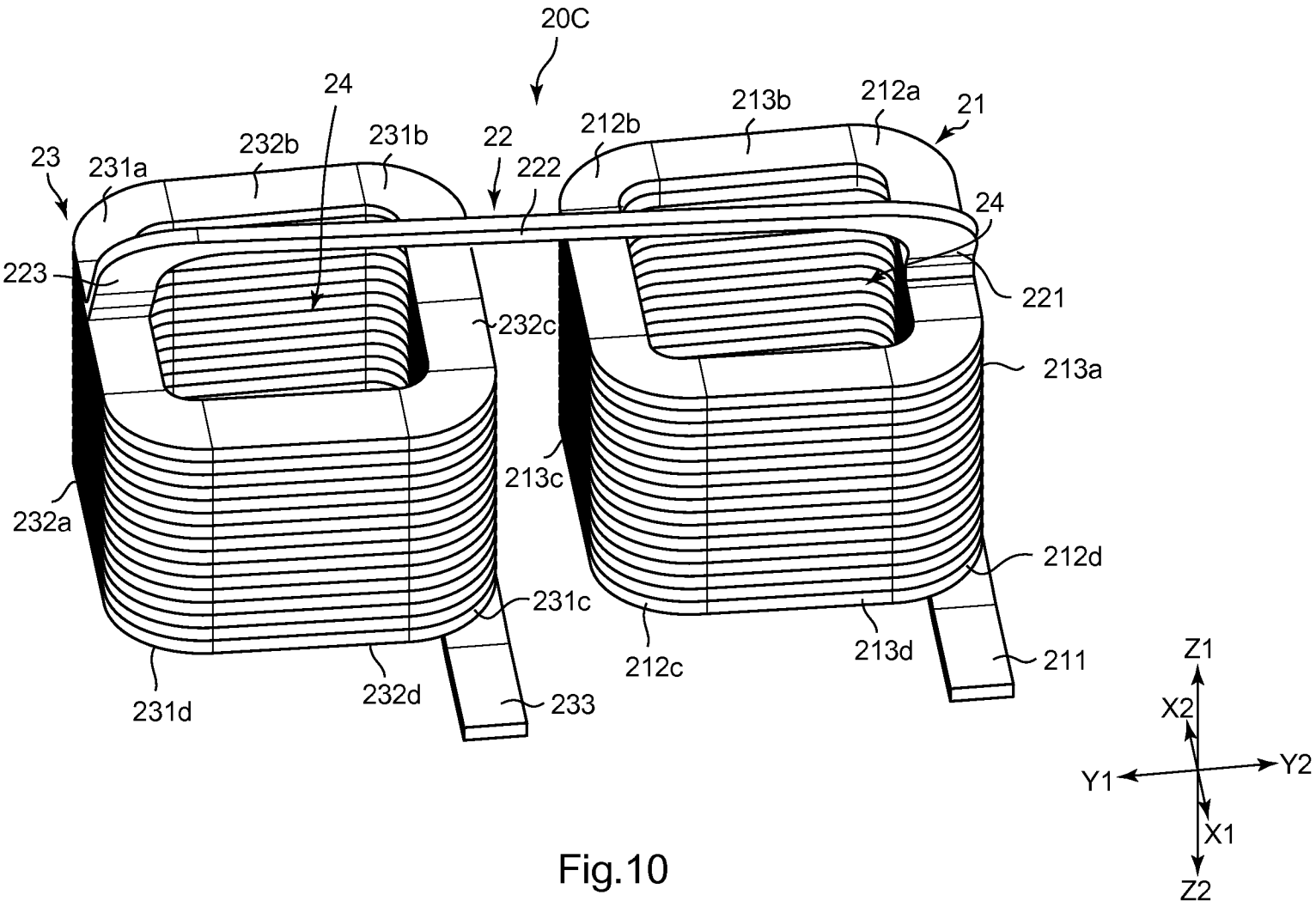
FIG. 10 is a perspective view illustrating a shape of a coil winding formed from the winding structure of FIG. 1 and illustrating a type different from FIG. 6 and FIG. 8.

Next, formation of the coil winding 20 (coil windings 20A to 20C) will be described. When the coil winding 20 is formed from the winding structure 200, a coil winding 20A as illustrated in FIG. 6, a coil winding 20B as illustrated in FIG. 8, and a coil winding 20C as illustrated in FIG. 10 are formed.

Figure 6:
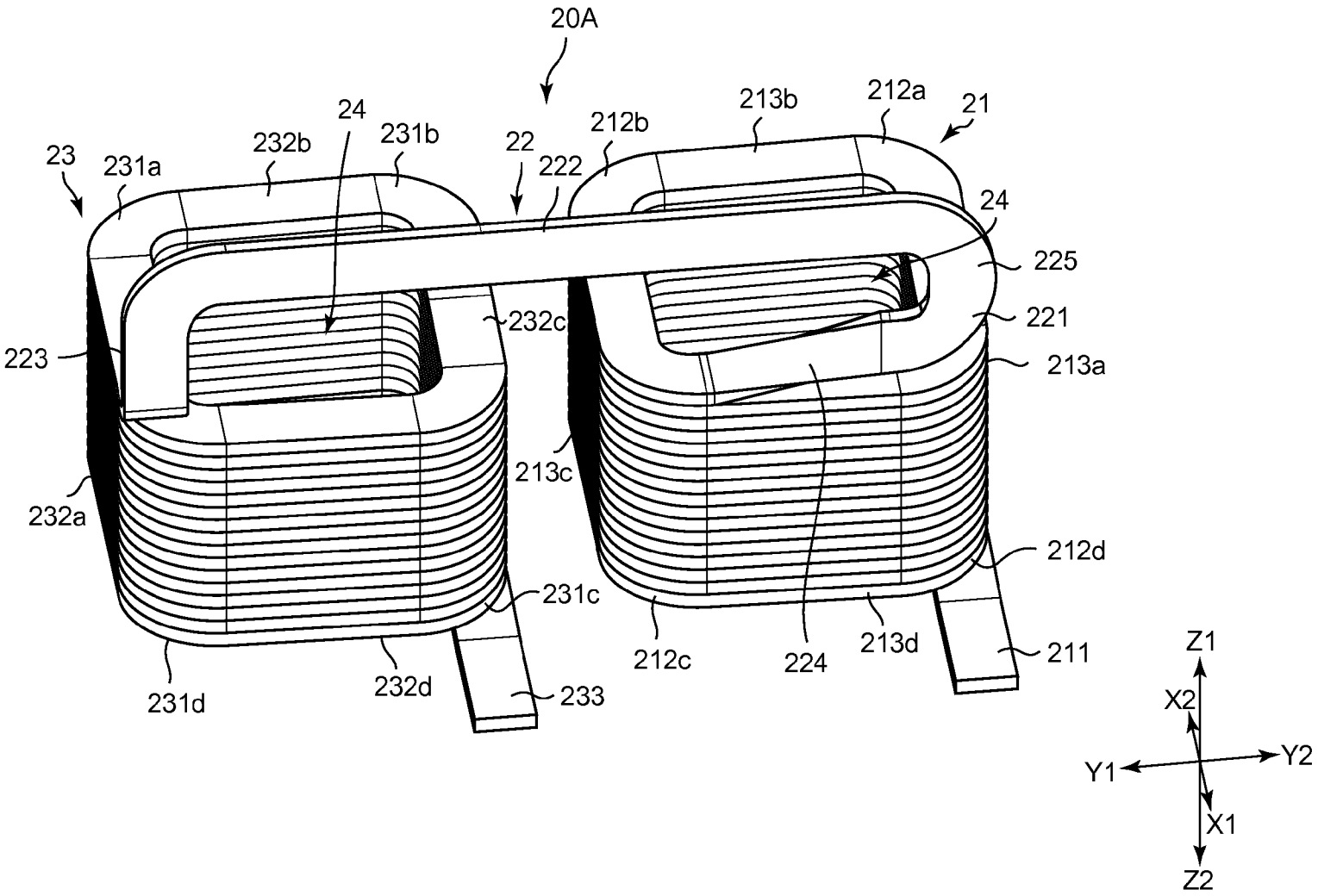
FIG. 6 is a perspective view illustrating a shape of a coil winding formed from the winding structure of FIG. 1.

(Regarding Formation of the Coil Winding 20A of the Type Illustrated in FIG. 6)

Figure 7:
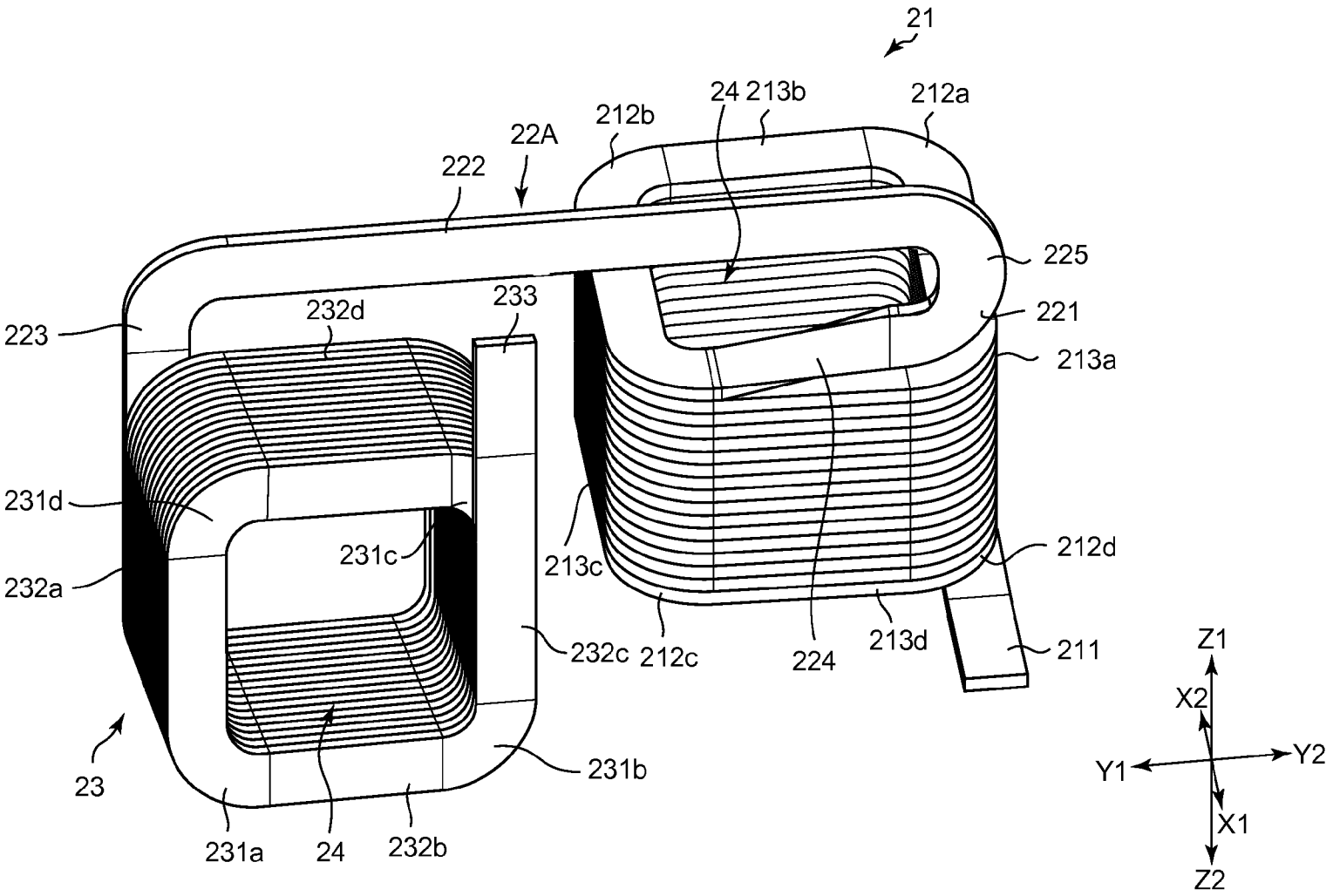
FIG. 7 is a perspective view illustrating a middle stage when the coil winding illustrated in FIG. 6 is produced.

First, the case of forming the coil winding 20A of the type illustrated in FIG. 6 will be described. In the following description, in the winding structure 200 illustrated in FIG. 1, it is assumed that a portion for twisting 224A is provided on a winding end side of the first winding part 21. This portion for twisting 224A is a component of the first coupling portion 221, and in FIG. 1, the portion for twisting 224A and a planar extending portion 225 are provided in the first coupling portion 221. When the coil winding 20A as illustrated in FIG. 6 is formed, as illustrated in FIG. 7, the portion for twisting 224A is twisted by approximately 90 degrees. In the structure illustrated in FIG. 7, the portion for twisting 224A is twisted so that the face (surface) of a side on which the flat wire H is not to be stacked faces toward an outer peripheral side of the first winding part 21 as it proceeds from the first winding part 21 to the planar extending portion 225.

By twisting such a portion for twisting 224A, a twisted portion 224 is formed. Then, by forming this twisted portion 224, the connecting wire part 22 formed from the part to be connecting wire 22A is provided in a state of standing up with respect to the first winding part 21.

Further, as illustrated in FIG. 6, before or after the formation of the twisted portion 224, a boundary portion between the second coupling portion 223 and the second winding part 23 is bent by approximately 90 degrees. The direction of this bending is such that a direction in which the second coupling portion 223 extends moves toward and away from the second winding part 23.

Note that when the boundary portion between the second coupling portion 223 and the second winding part 23 is bent, they may be bent by approximately 90 degrees with respect to the flat wire H constituting the second winding part 23. However, a front surface and a rear surface of the flat wire H constituting the second winding part 23 are not in parallel with the XY plane, but form an angle corresponding to the amount of thickness of the flat wire H on the XY plane. Accordingly, the above-described bending of the boundary portions by approximately 90 degrees may be bending so as to form approximately 90 degrees with respect to the XY plane. This point will be the same in the case of bending a boundary portion between the first coupling portion 221 and the first winding part 21 and the case of bending the boundary portion between the second coupling portion 223 and the second winding part 23 in FIG. 8 to FIG. 11, as will be described later.

By bending as described above, the coil winding 20 as illustrated in FIG. 6 is formed.

(Regarding Formation of the Coil Winding 20B Illustrated in FIG. 8)

Next, the case of forming the coil winding 20B as illustrated in FIG. 8 will be described. In the following description, it is assumed that the portion for twisting 224A as described above is not provided on the winding end side of the first winding part 21 in the winding structure 200 illustrated in FIG. 1.

Figure 9:
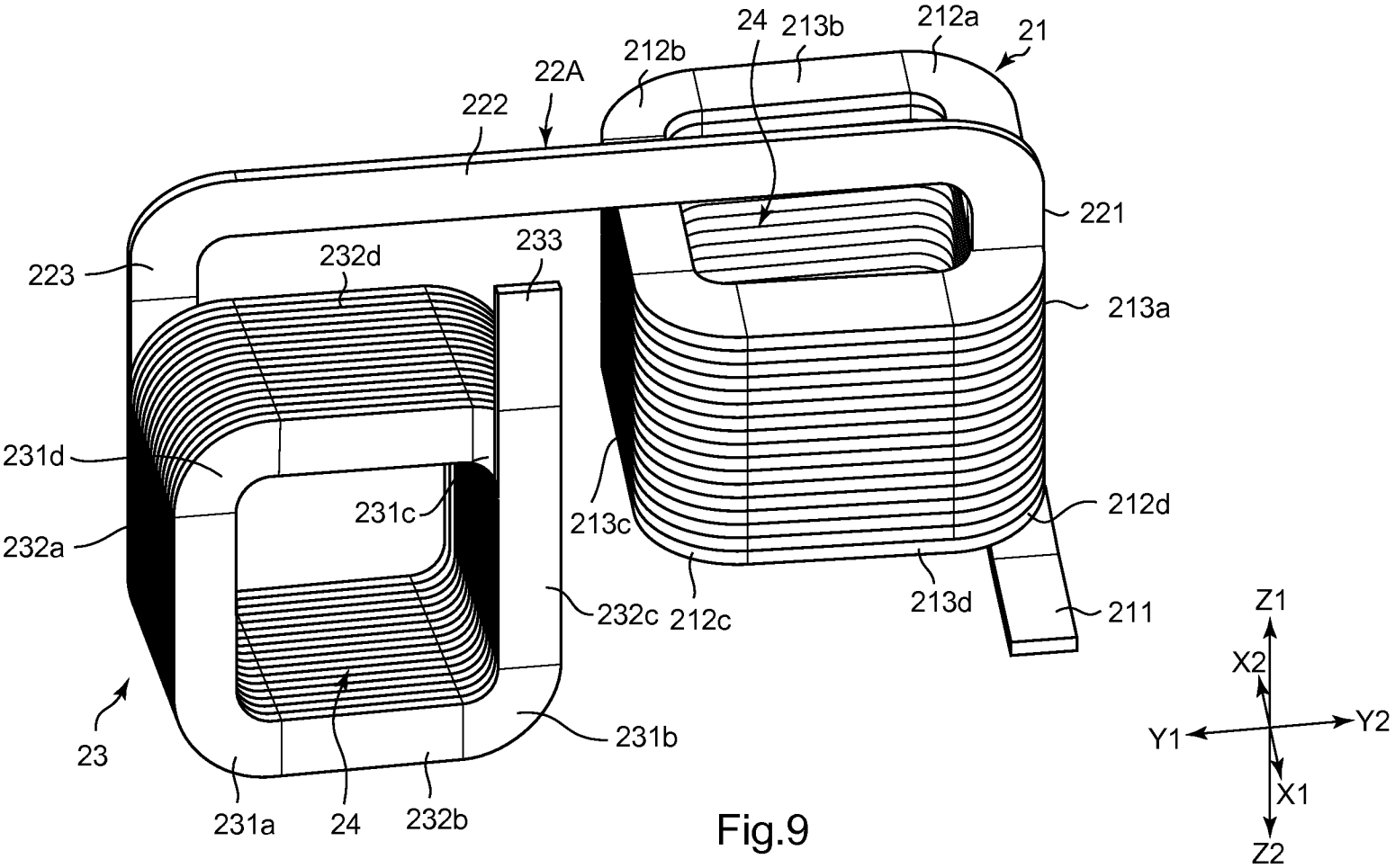
FIG. 9 is a perspective view illustrating a middle stage when the coil winding illustrated in FIG. 8 is produced.

When the coil winding 20B as illustrated in FIG. 8 is formed, the boundary portion between the first coupling portion 221 and the first winding part 21 of the winding structure 200 illustrated in FIG. 1 is bent by approximately 90 degrees. This state is illustrated in FIG. 9. The direction of this bending is a direction in which the first coupling portion 221 moves toward and away from the first winding part 21. Further, before or after bending of the boundary portion between the first coupling portion 221 and the first winding part 21, the boundary portion between the second coupling portion 223 and the second winding part 23 is bent by approximately 90 degrees. The direction of this bending is also a direction in which the second coupling portion 223 moves toward and away from the second winding part 23.

By performing bending as described above, the coil winding 20B as illustrated in FIG. 8 is formed.

(Regarding Formation of the Coil Winding 20C Illustrated in FIG. 10)

Next, the case of forming the coil winding 20C as illustrated in FIG. 10 will be described. Note that also in the coil winding 20C illustrated in FIG. 10, it is assumed that the portion for twisting 224A as described above is not provided on the winding end side of the first winding part 21.

Figure 11:
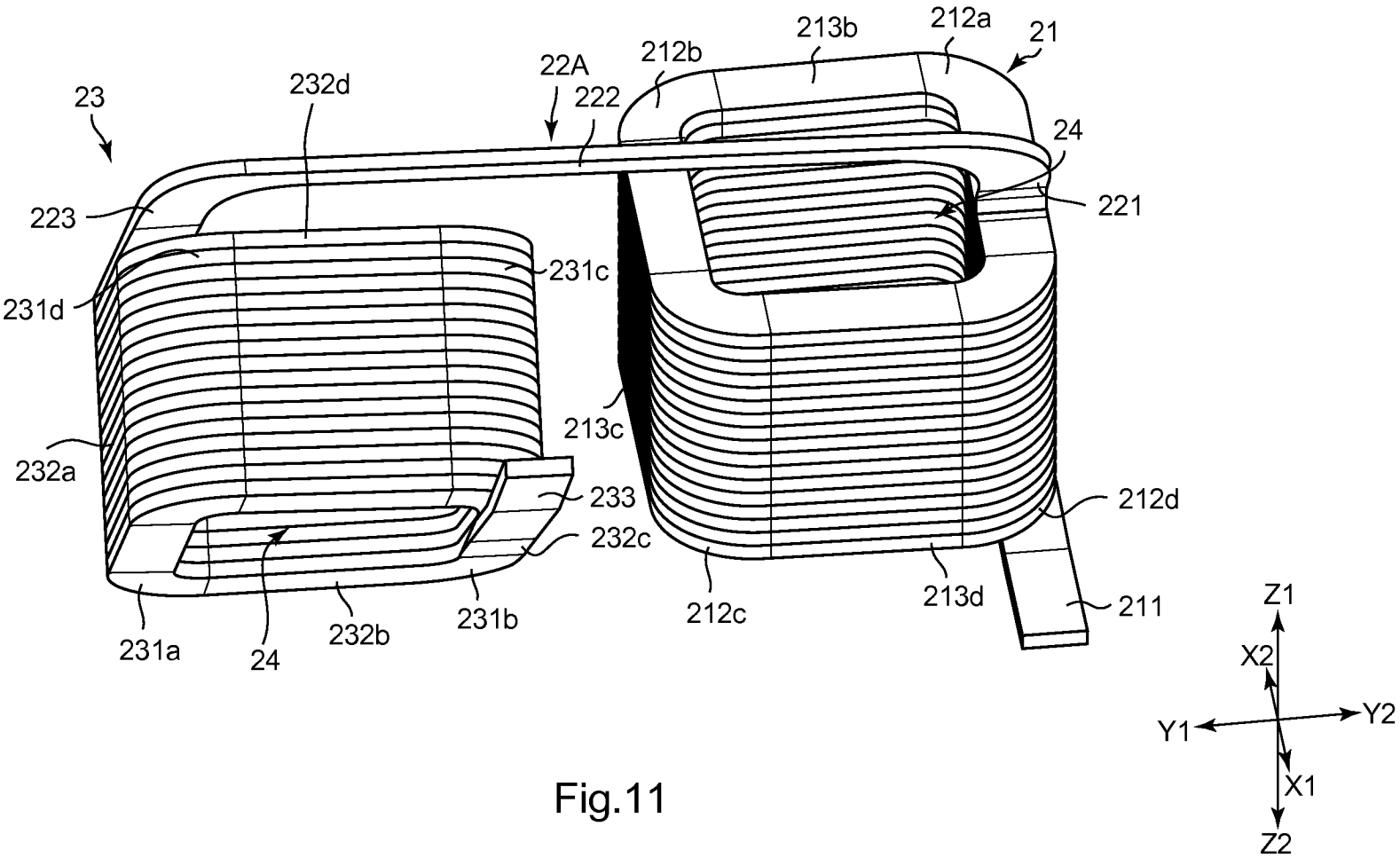
FIG. 11 is a perspective view illustrating a middle stage when the coil winding illustrated in FIG. 10 is produced.
Figure 12A:
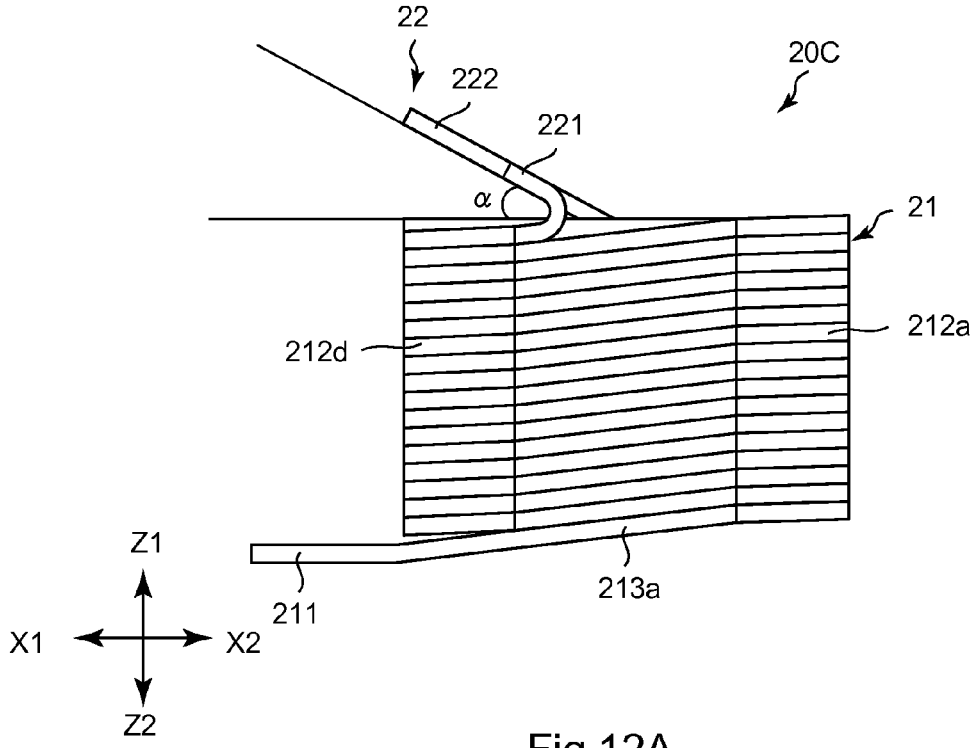
FIGS. 12A and 12B are side views illustrating a bending state of the flat wire in the coil winding illustrated in FIG. 10, FIG. 12A being a diagram illustrating a bending angle of the first coupling portion, FIG. 12B being a diagram illustrating a bending angle of the second coupling portion.

When the coil winding 20C as illustrated in FIG. 10 is formed, as illustrated in FIG. 11, the boundary portion between the first coupling portion 221 and the first winding part 21 is bent larger than 90 degrees. By this bending, on a side where the first coupling portion 221 continues to the first winding part 21, an angle formed between the XY plane perpendicular to the axial direction (Z direction) and the first coupling portion 221 is an acute angle $\alpha$ as illustrated in FIG. 12A.

Figure 12B:
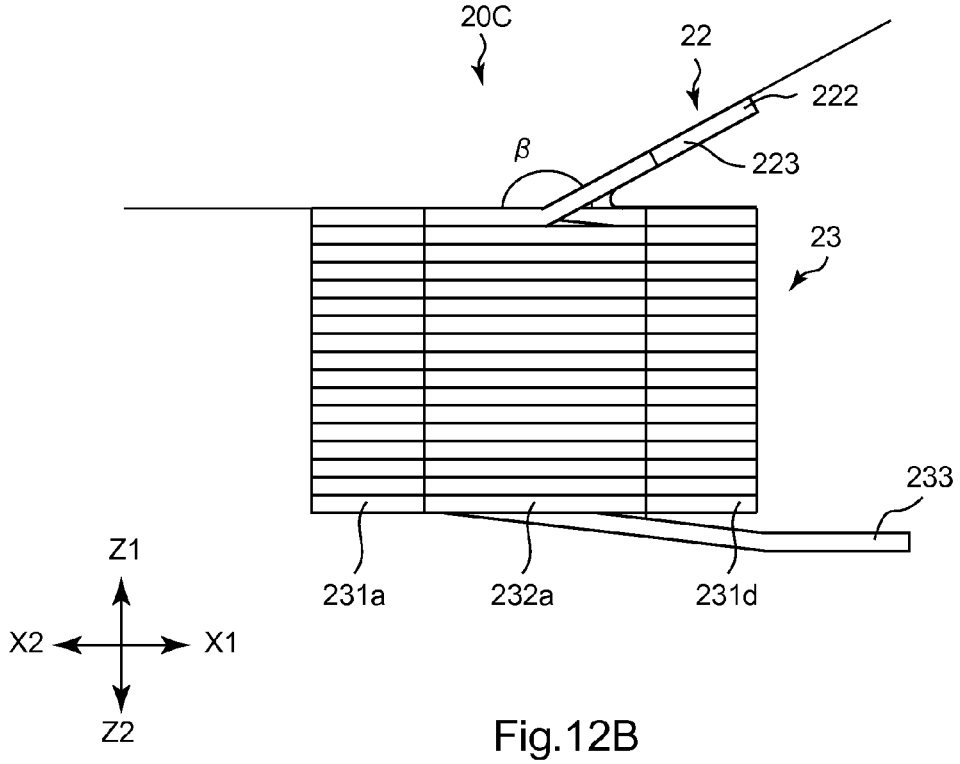

Further, before or after bending of the boundary portion between the first coupling portion 221 and the first winding part 21, the boundary portion between the second coupling portion 223 and the second winding part 23 is bent. The angle of bending at this time is an acute angle which does not exceed 90 degrees. By this bending, on a side where the second coupling portion 223 continues to the second winding part 23, an angle formed between the XY plane perpendicular to the axial direction (Z direction) and the second coupling portion 223 is an obtuse angle $\beta$ as illustrated in FIG. 12B. Note that in general, the obtuse angle $\beta$ is a value obtained by subtracting the acute angle $\alpha$ from 180 degrees.

Figure 13:
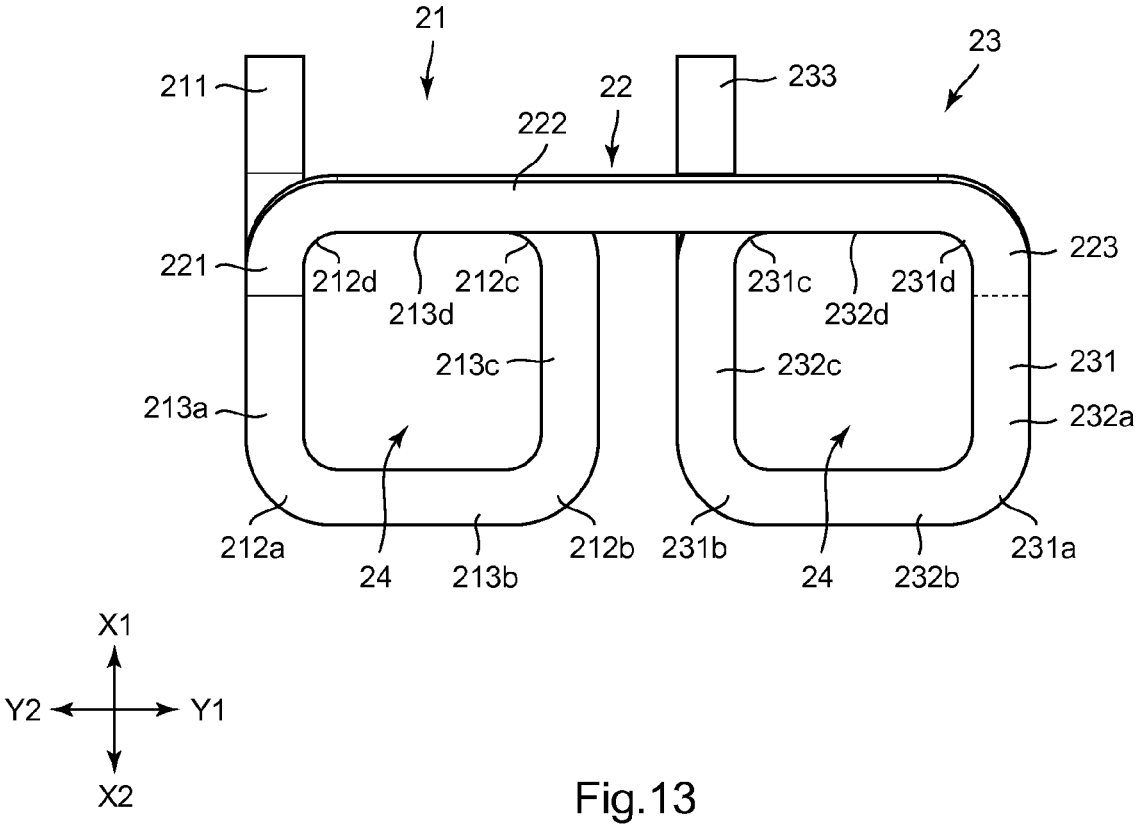
FIG. 13 is a is a plan view illustrating a shape of the coil winding of FIG. 10.

By bending the boundary portions as described above, the connecting wire part 22 is formed from the part to be connecting wire 22A. In this case, as illustrated in FIG. 10, the connecting wire part 22 is provided in an inclined state with respect to the axial direction (Z direction) as compared to the case illustrated in FIG. 8. Thus, when the coil winding 20C is seen in a plan view as illustrated in FIG. 13, it is possible to prevent the connecting wire part 22 from projecting largely toward the X1 side farther than the first winding part 21 and the second winding part 23.

<Regarding Formation of the Coil Part 10 Using the Coil Winding 20>

Figure 14:
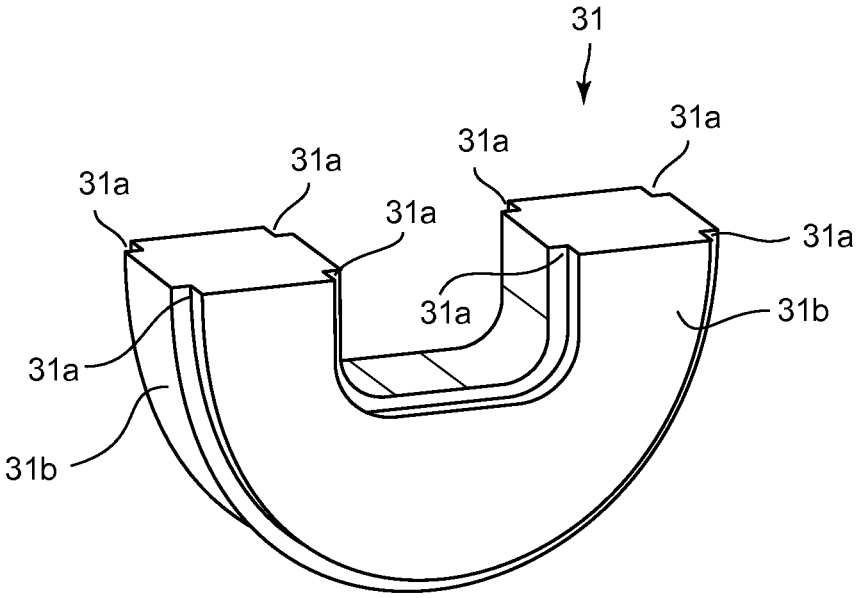
FIG. 14 is a perspective view illustrating a shape of a core constituting a coil part.

When the coil part 10 is formed using the coil winding 20 (coil windings 20A to 20C) as above, a core 31 as illustrated in FIG. 14 is formed separately from formation of the coil winding 20. The core 31 has a U-shape when seen in a side view (what is called a cut core), and a ring-shaped core body 30 (see FIG. 15 to FIG. 17) is formed by butting two such cores 31 having a U-shape. Note that in the following, a hole located on a center side of the ring-shaped core body 30 will be referred to as a ring hole 30A.

The core 31 is formed from a magnetic material, and such a magnetic material may be a stack of silicon steel plates as well as a metal magnetic material such as iron-based material, permalloy, sendust, amorphous metal, or the like, or an oxide magnetic material. However, a mixture of these magnetic materials may be used, or a composite material of these magnetic materials may be used.

As illustrated in FIG. 14, in this embodiment, the core 31 is provided to have the following cross-sectional shape. Specifically, it is provided to have a shape in which cutout parts 31*a* exist by cutting out four corners of a rectangle by a small rectangle. Existence of such cutout parts 31*a* enables to prevent interference of the bent portions 212*a* to 212*d* of the first winding part 21 and the bent portions 231*a* to 231*d* of the second winding part 23 with the core 31.

Before butting the two cores 31 as above, the coil winding 20 is retained on one core 31. At this time, leg portions 31*b* of the core 31 are in a state of being inserted into respective center holes 24 of the first winding part 21 and the second winding part 23 of the coil winding 20.

Thereafter, the other core 31 of the two cores 31 is butted against the one core 31. At this time, leg portions 31*b* of the other core 31 are in a state of being inserted into the respective center holes 24 of the first winding part 21 and the second winding part 23.

Then, the butted state of the one core 31 and the other core 31 is maintained. To maintain such a butted state, for example, an adhesive may be used to join butting faces of the cores 31 together, or the butted state of the cores 31 with each other may be maintained by any other joining means.

As described above, coil parts 10 as illustrated in FIG. 15 to FIG. 17 are produced. Note that the coil part 10A illustrated in FIG. 15 is one using the coil winding 20A illustrated in FIG. 6, the coil part 10B illustrated in FIG. 16 is one using the coil winding 20B illustrated in FIG. 8, and the coil part 10C illustrated in FIG. 17 is one using the coil winding 20C illustrated in FIG. 10.

<Effects>

Figure 18:
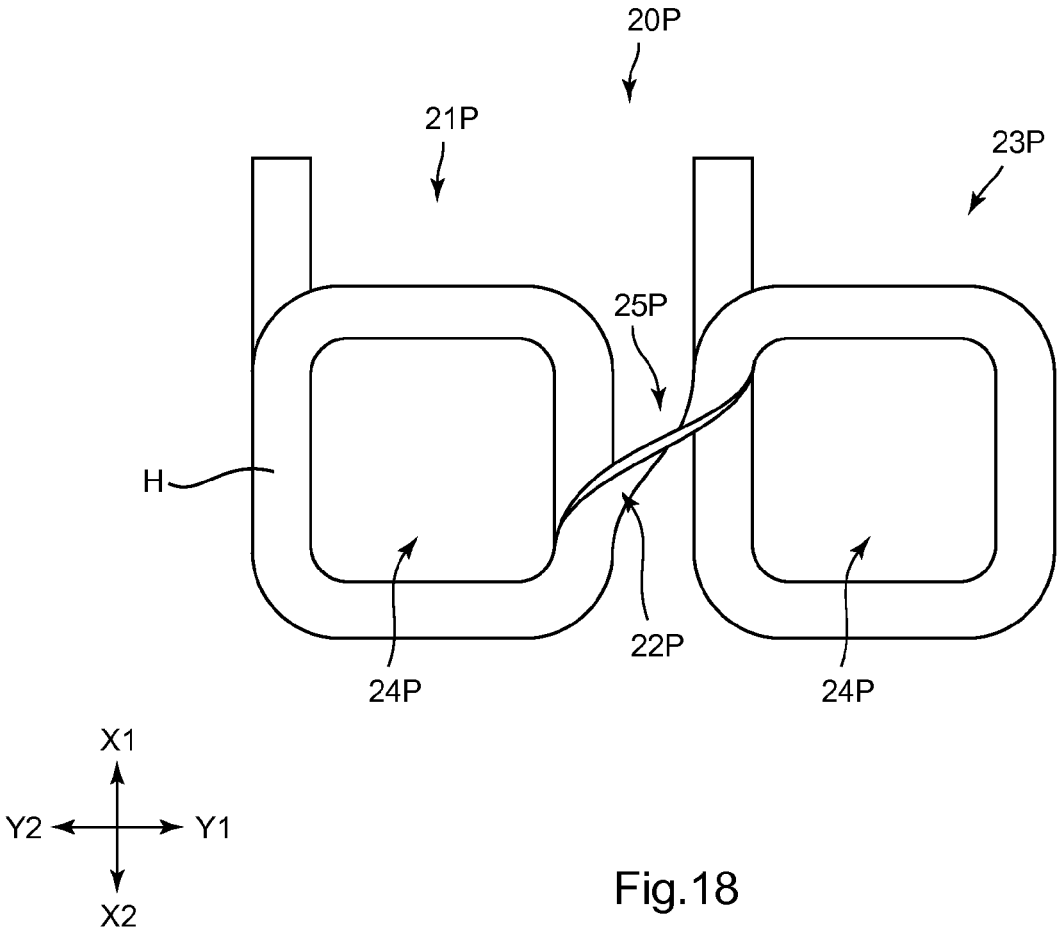
FIG. 18 is a plan view illustrating a structure of a conventional coil winding and illustrating a state that a twisted portion exists in a connecting wire part.
Figure 19:
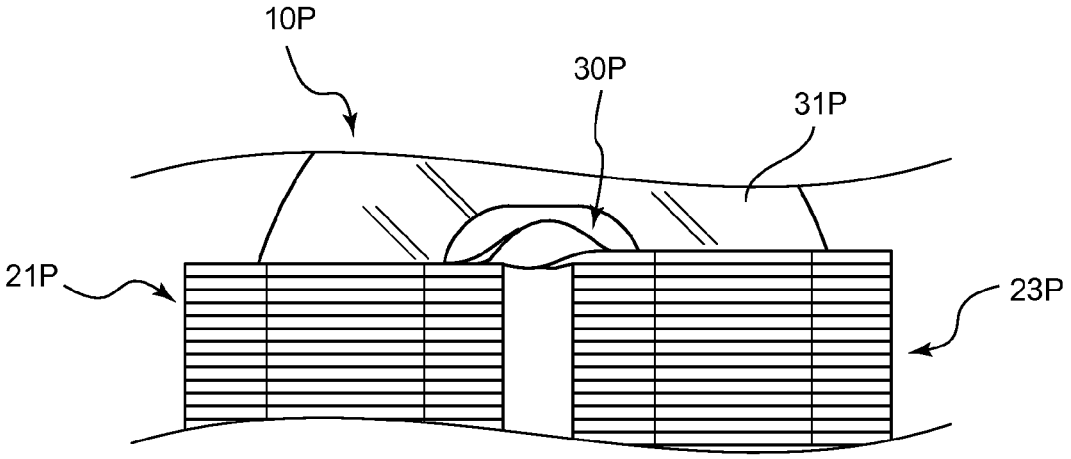
FIG. 19 is a partial side view illustrating the structure of the conventional coil part and is a view illustrating a structure in the vicinity of the twisted portion.

The winding structure 200, the coil winding 20, and the coil part 10 structured as above, and the manufacturing method of the coil winding 20 make it possible to prevent, when the connecting wire part 22 exists, enlargement of the ring hole 30A of the core body 30 due to the existence of the connecting wire part 22. That is, when the twisted portion 25P exists in a connecting wire part 22P connecting a first winding part 21P and a second winding part 23P as in the conventional coil winding 20P illustrated in FIG. 18, dimensions of the ring hole 30P become large so as to accommodate the twisted portion 25P as illustrated in FIG. 19. In this case, the largest length in the Z direction of the twisted portion 25P is approximately the same as the width of the flat wire H. Accordingly, an extra space is needed in the ring hole 30P, and the coil part 10P as the whole becomes large by the amount of the space.

Figure 15:
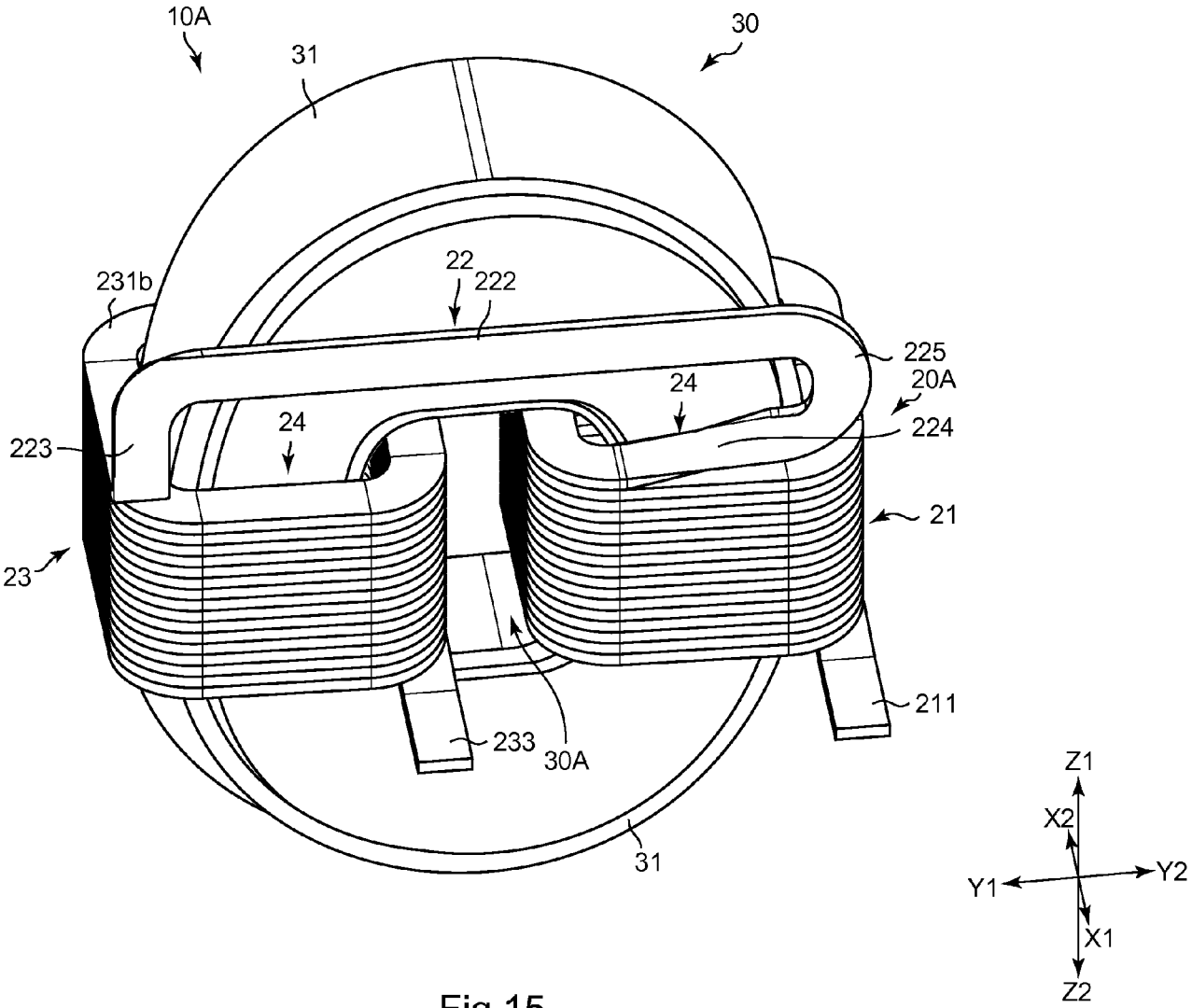
FIG. 15 is a perspective view illustrating a coil part produced using the coil winding illustrated in FIG. 6.
Figure 16:
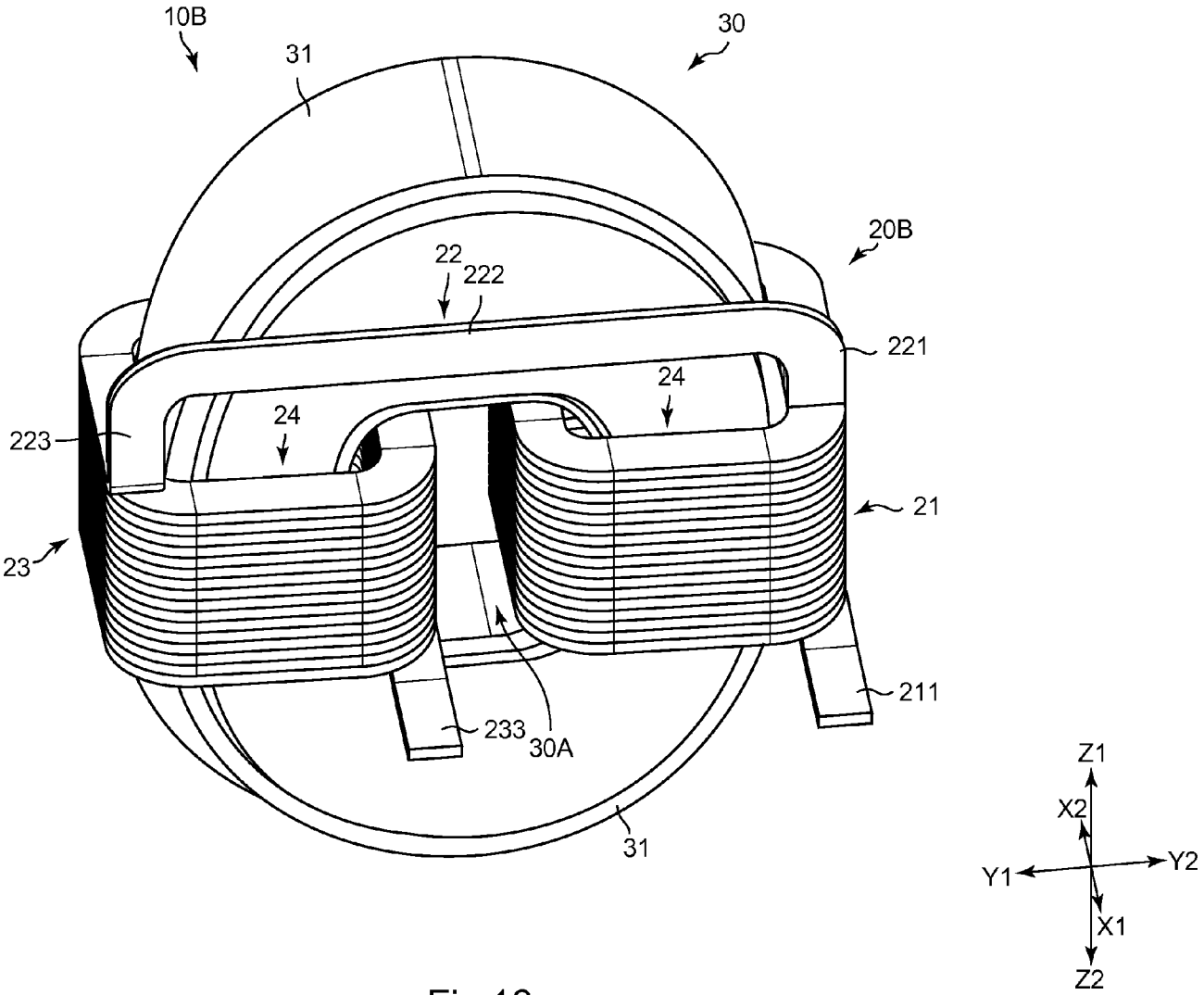
FIG. 16 is a perspective view illustrating a coil part produced using the coil winding illustrated in FIG. 8.
Figure 17:
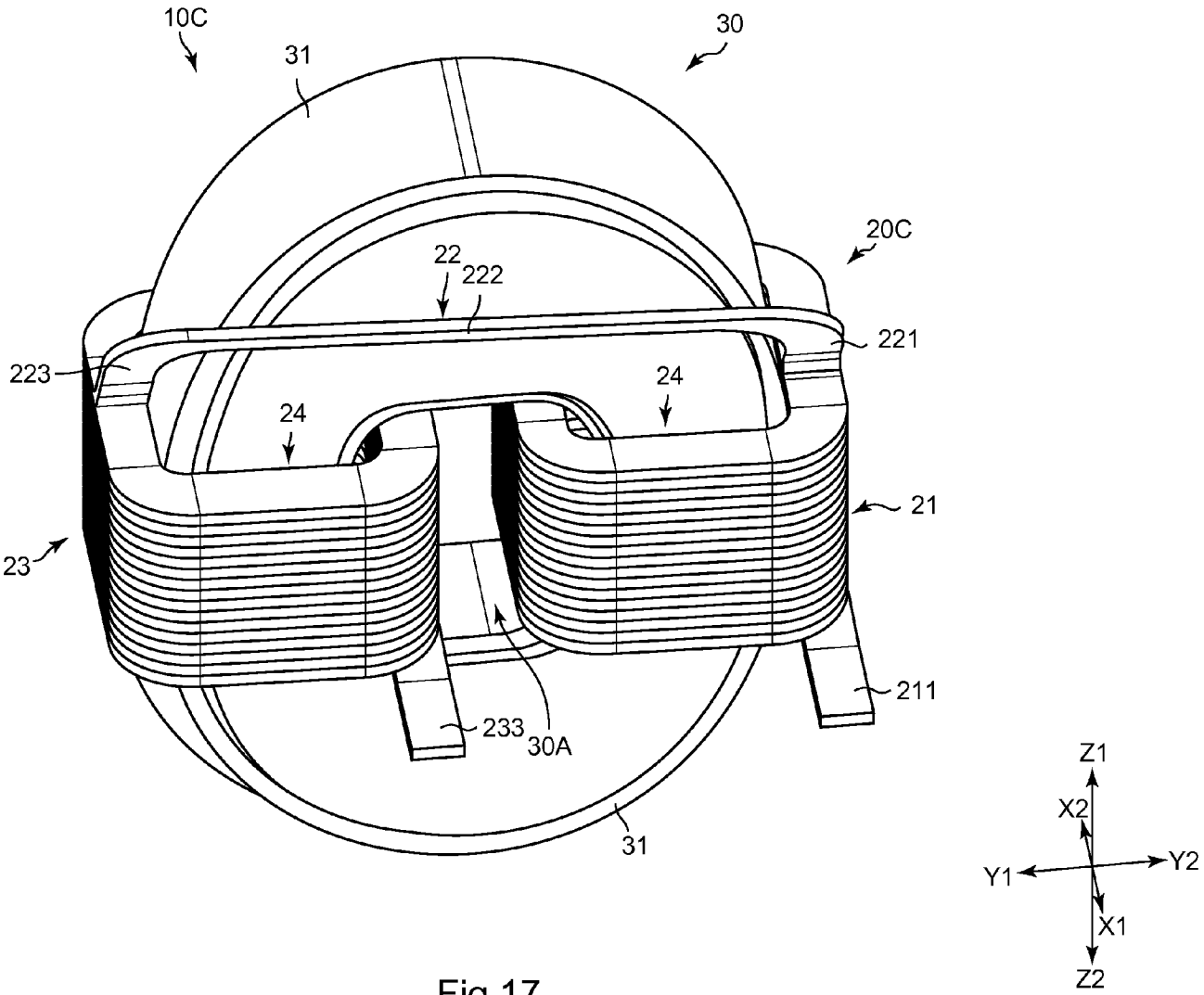
FIG. 17 is a perspective view illustrating a coil part produced using the coil winding illustrated in FIG. 10.

However, the above-described coil parts 10 illustrated in FIG. 15 to FIG. 17 have a structure in which the twisted portion 25P does not exist in the ring hole 30A. Thus, the extra space due to existence of the twisted portion 25P is not needed, and dimensions of the ring hole 30A can be made small. This allows reducing dimensions of the coil part 10.

Further, upon forming the connecting wire part 22, the winding structure 200 having the part to be connecting wire 22A as illustrated in FIG. 1 is used. Moreover, the part to be connecting wire 22A is provided with the first coupling portion 221 and the second coupling portion 223, and existence of the first coupling portion 221 and the second coupling portion 223 allows separating the interval defining portion 222 sufficiently from the first winding part 21 and the second winding part 23. Thus, the interval defining portion 222 is not located at a position of the ring hole 30A but can be located at a position separated from the ring hole 30A, allowing reduction of dimensions of the ring hole 30A. This allows reducing dimensions of the core body 30, and also allows reducing dimensions of the coil part 10.

Note that in the connecting wire part 22, the first coupling portion 221 and the second coupling portion 223 exist besides the interval defining portion 222, and by the first coupling portion 221 and the second coupling portion 223, the interval defining portion 222 can be located at a position separated from the ring hole 30A, and thus a disposition not causing interference of the interval defining portion 222 with the core body 30 can be realized.

Further, in the coil part 10 of this embodiment, a disposition is also possible such that the connecting wire part 22 is located within the range of seeing the first winding part 21 and the second winding part 23 of the coil winding 20 in a plan view. This allows realizing space reduction of the coil part 10.

Further, in the above-described embodiment, the directions of edgewise bending of the first winding part 21, the part to be connecting wire 22A, and the second winding part 23 are all the same in the winding structure 200. This facilitates formation of the winding structure 200. Here, when the directions of edgewise bending are in reverse, a labor such as changing the direction of setting the flat wire H so as to reverse a front side and a rear side occurs, and complication of the structure of the bending machine, and the like occur. However, since the directions of edgewise bending are all the same in the winding structure 200 as described above, it is possible to simplify labor during processing. Further, use of a bending machine having a complicated structure can be avoided.

Further, in this embodiment, as illustrated in FIG. 1 and FIG. 2, in the winding structure 200, the terminal portion 211 of the first winding part 21 and the terminal portion 233 of the second winding part 23 are provided so that directions toward their respective front end sides are opposite directions from each other (the terminal portion 211 is on the X1 side and the terminal portion 233 is on the X2 side). Moreover, the terminal portion 211 is located on an outer peripheral side (Y2 side of the first winding part 21) where the first winding part 21 and the second winding part 23 do not face each other, and the terminal portion 233 is located on the side (Y2 side of the second winding part 23) where the first winding part 21 and the second winding part 23 face each other.

When the coil winding 20 is formed using such a winding structure 200, it is possible to make the directions of the terminal portions 211, 233 the same. In addition, it is possible to separate the terminal portion 211 and the terminal portion 233 in the Y direction. This facilitates mounting of the coil part 10, and allows preventing occurrence of short circuit between these terminal portions 211, 233 upon mounting.

Further, in this embodiment, the coil winding 20A of the type illustrated in FIG. 6 can be formed from the winding structure 200 illustrated in FIG. 1. Specifically, the first coupling portion 221 is provided with the planar extending portion 225 continuing to the interval defining portion 222 by forming an edgewise bending and the portion for twisting 224A which becomes the twisted portion 224 by being twisted later. Then, by twisting the portion for twisting 224A as illustrated in FIG. 6, the twisted portion 224 can be formed. Further, by providing the twisted portion 224, the interval defining portion 222 can be positioned on the Z1 side of the twisted portion 224, realizing a disposition not causing interference with the core 31.

Here, the portion for twisting 224A is twisted so that the face (surface) of a side on which the flat wire H is not to be stacked faces toward an outer peripheral side of the first winding part 21 as the flat wire H proceeds from the first winding part 21 to the interval defining portion 222. By realizing such twisting, when the first winding part 21 and the second winding part 23 are formed, it is possible to make the directions of their windings the same, and thus it is possible to facilitate formation of the winding structure 200.

Note that when it is twisted in an opposite direction to the above-described twisting direction, the direction of winding of the second winding part 23 is opposite to that of the first winding part 21, and there may occur a labor of reversing the position to set the flat wire H in the bending machine, or the like. However, when the direction of winding of the second winding part 23 is further reversed with respect to the first winding part 21 as the opposite twisting direction, effects similar to those of this embodiment can be generated.

Further, in this embodiment, it is possible to form the coil winding 20B of the type illustrated in FIG. 8. Specifically, the coil winding 20B can be formed using the winding structure 200 by bending the boundary portion between the first coupling portion 221 and the first winding part 21 so that the first coupling portion 221 is directed toward the Z direction (direction in parallel with the axial direction), and further bending the boundary portion between the second coupling portion 223 and the second winding part 23 so that the second coupling portion 223 is directed toward the Z direction. Further, since the coil winding 20B is formed by just bending the winding structure 200, the coil winding 20B can be formed easily.

Moreover, in this embodiment, it is possible to form the coil winding 20C of the type illustrated in FIG. 10. Specifically, the boundary portion between the first coupling portion 221 and the first winding part 21 is bent so that an extending direction of the first coupling portion 221 is provided obliquely with respect to the axial direction (Z direction) of the first winding part 21. In addition, the boundary portion between the second coupling portion 223 and the second winding part 23 is bent so that an extending direction of the second coupling portion 223 is provided obliquely with respect to the axial direction (Z direction) of the second winding part 23.

Thus, the interval defining portion 222 can be located at a position on the outer peripheral side (X1 side) of the first winding part 21 and the second winding part 23 with respect to the bent portion, and hence a disposition not causing interference between the core body 30 and the interval defining portion 222 can be realized.

Modification Example

The winding structure 200, the coil winding 20, the coil part 10, and the manufacturing method of the coil winding 20 according to one embodiment of the present invention have been described above. Besides them, the present invention can be modified in various ways. Such modifications will be described below.

In the above-described embodiment, the first winding part 21 and the second winding part 23 are wound in a rectangular shape. However, the first winding part 21 and the second winding part 23 are not limited to the structure of being wound in a rectangular shape, and may be wound in a different shape, such as a circle, an ellipse, or a polygon such as a triangle.

Further, in the above-described embodiment, the direction of bending the boundary portion between the first coupling portion 221 and the first winding part 21 and the direction of bending the boundary portion between the second coupling portion 223 and the second winding part 23 are provided to be opposite. However, the directions of bending these two boundary portions may be the same direction. In this case, one is right bending and the other is left bending between the edgewise bending when the first winding part 21 is formed and the edgewise bending when the second winding part 23 is formed.

Further, in the above-described embodiment, as illustrated in FIG. 2, the interval defining portion 222 is structured to be located on the X1 side with respect to the straight portion 213*b*. Accordingly, the first coupling portion 221 is shorter than the straight portion 213*a*. However, the first coupling portion 221 may be formed to have about the same length as the straight portion 213*a* by providing the interval defining portion 222 at a position equivalent to the straight portion 213*b* in the X direction. In this case, the length of the second coupling portion 223 also becomes approximately the same length as the first coupling portion 221. Further, the first coupling portion 221 may be formed to be longer than the straight portion 213*a* by providing the interval defining portion 222 on the X2 side with respect to the straight portion 213*b* in the X direction.

The winding structure, the coil winding, the coil part, and the coil winding manufacturing method of the present invention can be used in the field of electric equipment.

DESCRIPTION OF REFERENCE NUMERALS

10, 10A to 10C, 10P . . . coil part
20, 20A to 20C, 20P . . . coil winding
21, 21P . . . first winding part
22, 22P . . . connecting wire part
22A . . . part to be connecting wire
23, 23P . . . second winding part
24 . . . center hole
25P . . . twisted portion
30 . . . core body
30A, 30P . . . ring hole
31 . . . core
31*a* . . . cutout part
31*b* . . . leg portion
200 . . . winding structure
211 . . . terminal portion (corresponding to first terminal)
212*a* to 212*d* . . . bent portion
213*a* to 213*d* . . . straight portion
221 . . . first coupling portion
222 . . . interval defining portion, 223 . . . second coupling portion
224 . . . twisted portion
224A . . . portion for twisting
225 . . . planar extending portion
231*a* to 231*d* . . . bent portion
233 . . . terminal portion (corresponding to second terminal)
H . . . flat wire
M . . . bending part
P . . . processing unit
P1 . . . inner jig
P2 . . . outer jig

What is claimed is:

1. A coil winding, comprising:

a first winding part formed by winding a flat wire;

a second winding part formed by winding the flat wire continuing to the first winding part, the second winding part being wound in a same winding direction as a winding direction of the first winding part; and a connecting wire part located between the first winding part and the second winding part to connect the winding parts, wherein the connecting wire part comprises:

an interval defining portion defining an interval between the first winding part and the second winding part;

a first coupling portion with one end side continuing to the interval defining portion by forming an edgewise bending and another end side continuing to the first winding part on one side in an axial direction of the first winding part; and a second coupling portion with one end side continuing to the interval defining portion by forming an edgewise bending and another end side continuing to the second winding part on another side in an axial direction of the second winding part, wherein the first coupling portion is continuing to the first winding part at the side opposite to the side facing the second winding part; and the second coupling portion is continuing to the second winding part at the side opposite to the side facing the first winding part.

2. The coil winding according to claim 1, wherein the first coupling portion is provided with:

a planar extending portion continuing to the interval defining portion by forming an edgewise bending; and a twisted portion which is located between the first winding part and the planar extending portion, wherein the flat wire is twisted so that the width of the flat wire extends in a direction to depart from the first winding part as the flat wire proceeds from the first winding part to the planar extending portion.

3. The coil winding according to claim 1, wherein a first terminal on a side opposite to the connecting wire part and a second terminal on a side opposite to the connecting wire part extend in a same direction as each other toward respective front end sides thereof, and one of the first terminal and the second terminal is located on a facing portion side where the first winding part and the second winding part face each other, and the other of the first terminal and the second terminal is located on an outer peripheral side where the first winding part and the second winding part do not face each other.

4. The coil winding according to claim 1, wherein a boundary portion between the first coupling portion and the first winding part is bent so that the first coupling portion extends in a direction to depart from the first winding part, a boundary portion between the second coupling portion and the second winding part is bent so that the second coupling portion extends in a direction to depart from the second winding part.

5. The coil winding according to claim 4, wherein the boundary portion between the first coupling portion and the first winding part is bent so that an extending direction of the first coupling portion is provided in substantially parallel with an axial direction of the first winding part, and the boundary portion between the second coupling portion and the second winding part is bent so that an extending direction of the second coupling portion is provided in substantially parallel with an axial direction of the second winding part.

6. The coil winding according to claim 4, wherein the boundary portion between the first coupling portion and the first winding part is bent so that an extending direction of the first coupling portion is provided obliquely with respect to an axial direction of the first winding part, and the boundary portion between the second coupling portion and the second winding part is bent so that an extending direction of the second coupling portion is provided obliquely with respect to an axial direction of the second winding part.

7. A coil part, comprising:

the coil winding according to claim 1; and a core body formed from a magnetic material, provided in a ring shape, and inserted through a center hole of the first winding part and a center hole of the second winding part.

8. A coil winding manufacturing method for forming a coil winding from a flat wire, the method comprising:

a first winding step comprising winding the flat wire to form a first winding part;

a part to be connecting wire forming step of comprising forming a part to be connecting wire continuing to the first winding part;

a second winding step comprising winding the flat wire in a same winding direction as a winding direction of the first winding part to form a second winding part continuing to the part to be connecting wire; and a connecting wire part forming step comprising forming a connecting wire part from the part to be connecting wire, wherein the part to be connecting wire forming step comprises:

a first feeding step comprising feeding, after the first winding step and before the second winding step, the flat wire farther than a bending part to provide a first fed portion continuing to the first winding part;

a first bending step comprising performing, at the bending part after the first feeding step, edgewise bending of the flat wire in the same direction as the winding direction of the first winding part to form a first coupling portion continuing to the first winding part at a side opposite to a side where the first winding part and the second winding part face each other;

a second feeding step of comprising feeding, after the first bending step, the flat wire to provide a second fed portion;

a second bending step comprising performing, at the bending part after the second feeding step, edgewise bending of the flat wire in the same direction as the winding direction of the first winding part to form an interval defining portion continuing to the first coupling portion and defining an interval between the first winding part and the second winding part; and a third feeding step comprising feeding, after the second bending step, the flat wire farther than the bending part to provide a third fed portion with a second fed portion continuing to the interval defining portion and the second winding part at the side opposite to the side where the first winding part and the second winding part face each other.

* * * * *